United States Patent [19]

Fromaget

[11] 4,210,293

[45] Jul. 1, 1980

Best Available Copy

[54] STRAND TRANSFER

[75] Inventor: Georges Fromaget, Servolex, France

[73] Assignee: Saint-Gobain Industries, Neuilly-sur-Seine, France

[21] Appl. No.: 37,538

[22] Filed: May 10, 1979

[30] Foreign Application Priority Data

May 12, 1978 [FR] France ..... 78 14143

[51] Int. Cl.[2] ..... B65H 54/02; B65H 67/04

[52] U.S. Cl. ..... 242/18 A

[58] Field of Search ..... 242/18 A, 25 A, 19, 242/35.5 A, 48, 18 PW, 18 G

[56] References Cited

U.S. PATENT DOCUMENTS

| | | | |
|---|---|---|---|
| 1,809,660 | 6/1931 | Wild et al. | 242/18 A X |
| 2,789,774 | 4/1957 | Petersen et al. | 242/18 A |
| 3,090,570 | 5/1963 | Cunningham et al. | 242/18 A |
| 3,109,602 | 11/1963 | Smith | 242/18 A |
| 3,279,709 | 10/1966 | Carlson et al. | 242/18 A |
| 3,409,238 | 11/1968 | Campbell et al. | 242/18 A |
| 3,521,826 | 7/1970 | Schmick | 242/18 A |

FOREIGN PATENT DOCUMENTS

| | | | |
|---|---|---|---|
| 2118147 | 10/1972 | Fed. Rep. of Germany | 242/18 A |
| 1415295 | 9/1965 | France | 242/18 A |
| 45-34423 | 11/1970 | Japan | 242/18 A |
| 199325 | 9/1967 | U.S.S.R. | 242/18 A |

*Primary Examiner*—Stanley N. Gilreath

*Attorney, Agent, or Firm*—John T. Synnestvedt; Charles H. Lindrooth

[57] ABSTRACT

A process and apparatus for strand transfer is disclosed. The transfer occurs during the exchange of two winding collets in which the first, full collet, is shifted to the position where it is emptied while the second, empty collet, picks up the strand. According to the disclosure, the linear drive speed of the first collet is reduced; the arc of contact of the strand on the circumference of the second collet is increased as the second collet arrives at the position previously occupied by the first; the portion of the strand travelling from one to the other is engaged between the collets and the engagement of this portion is maintained and progressive breaking of the strand by abrasion is effected until the second collet takes up the strand. A novel device comprising a moveable means capable of introducing and maintaining the strand in position between the two collets and abrading the strand until the transfer has taken place is disclosed.

14 Claims, 14 Drawing Figures

FIG.1A
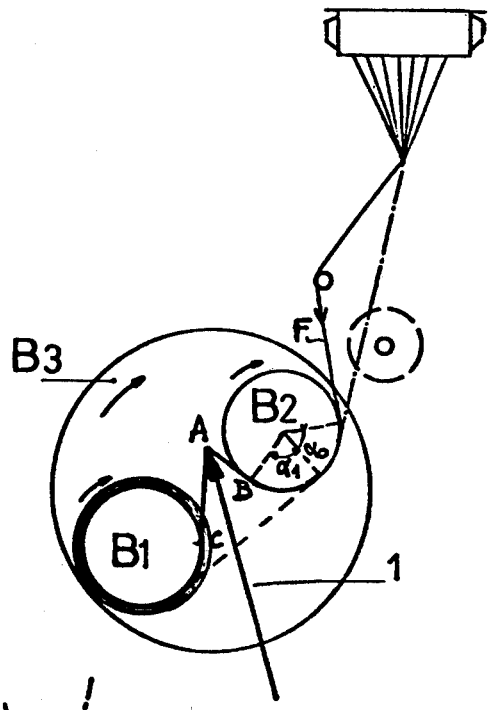
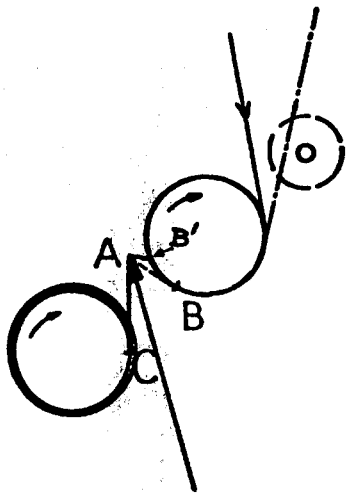
FIG.1B
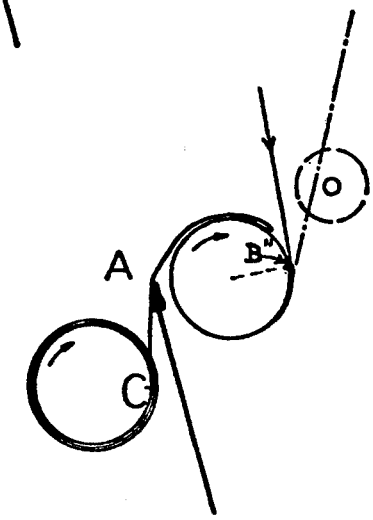
FIG.1C

STRAND TRANSFER

FIELD OF INVENTION

The invention is particularly applicable to the continuous attenuation and winding of fiberizable material such as fiberglass strands.

BACKGROUND OF THE INVENTION

In the manufacture of continuous glass strands by mechanical attenuation of glass from a bushing, the filaments are drawn at a uniform linear speed and are generally wound on sleeves supported by cylindrical mandrels, called collets, with the help of a traverse guide or similar distribution device which provides for substantially even distribution lengthwise of a sleeve. The filaments coming out of the bushing are grouped either in a single strand wound on a single sleeve, or in several strands wound simultaneously on several sleeves placed end to end on the same collet. For reasons of productivity, it is particularly important to assure the continuity of this operation.

In order to do this, when the desired quantity of strand has been wound onto the first collet, the collet is shifted from the work position, while the attenuation of the strand is continued. A second, empty collet, already rotating, then takes the place of the first, picks up the strand which is still being attenuated, and assumes the winding. In certain particular cases, the strands can be picked up directly and separately by each sleeve. In more customary fashion, on turret winders, the strands which have been temporarily regrouped in the course of attenuation are picked up in a special zone at the end of the empty collet, and then each strand is led back onto its own sleeve in order to begin a new winding.

The operating sequence is therefore the following:

- placing the empty collet in rotation;
- lateral ejection of the strands on the end of the full collet;
- inversion of the position of the collets by rotation of the turret which supports them;
- fastening the strands onto the empty collet; and removal of the strand on its respective sleeve.

In what follows, we call "transfer" the phenomenon or action of fastening the strand onto the empty collet (or the empty sleeve) and "transfer operation" the operations whose general outline has just been given above.

There is a simple process for assuring the transfer by rapid deceleration of the full collet in arriving at the rest position, while the empty collet in reaching the work position turns at normal strand winding speed. Because of the increasing difference between the two speeds, the empty collet finally takes precedence because the adhesive forces between the surface of the collet and the strand become greater than the traction applied by the full collet; a loop is formed between the two collets, which is immediately held tight by adhesion on the empty collet, beginning the winding process onto the latter. See U.S. Pat. No. 3,409,238 for an apparent illustration of this process.

According to U.S. Pat. No. 1,809,660 a knife is introduced very rapidly between the two collets during their exchange in such a way as to cut artificial silk thread; the trailing end of the thread, separated from the full collet, is held tight under the thread originating from above.

Transfer can be obtained directly on the sleeve, but it is more easily effected if performed at the end of the collet on a special portion formed as a highly polished cylindrical extension.

The transfer process described above is also applicable to winders winding more than two strands simultaneously, the transfer being made as a whole for all the strands which are regrouped if there is room. However, the process will work only for certain strands. In effect, for a given attenuation speed, the traction applied by the full collet increases in proportion to the number of filaments. Over a certain limit, the drawing by adhesion still remains less than the attenuation force which must continue to be exerted, and the transfer of the strand onto the empty collet is thus not effected, for when the count of the strand increases, the entrainment by adhesion does not increase proportionately, because the filaments which make up the strand are bundled and do not all have contact with the surface of the empty collet, and also because the strand is more rigid.

This is why many other solutions, more complex and thus more expensive, have been subsequently proposed. Generally, however, they have proved to be imperfect in a variety of ways.

The end of the collet, for example, has been equipped with a circular plate. At the end of the ejection step, the strand is wedged into an orifice at the circumference bounded by the plate and the end of the collet as the first winding is made.

If the plate is held close by elastic forces, its tension should be low enough so that each strand enters the orifice, and sufficiently strong to keep it there after its entrance. In view of the important differences which can exist between one strand and another, there must be provision for adjustment in the majority of cases. Besides, the orifice must be cleaned by hand to remove the strand held tight at the end of each transfer operation. Also proposed is a definite control of the plate, associated with cleaning of the orifice by the action of a liquid under pressure. But, because of its complexity, this last device is expensive to make and to maintain.

SUMMARY AND OBJECTS OF THE INVENTION

Thus, the present invention concerns a process and apparatus for the transfer of one or several strands during attenuation, (but placed outside the distribution device) from a full rotating collet to an empty collet also rotating, and afterwards the exchange of these collets. Despite its simplicity, this transfer process is applicable to many different applications and permits in particular the transfer of strands of high count; it can be used on all winding turrets, whether the strands are, with a view to transfer:

- ejected together on the end of the collet;
- ejected separately on the ends of their respective sleeves; or
- simply removed from contact by the distribution device (traverse oscillators, opposite which the strands remain without being subjected to their action).

According to the invention, the portions of the strand which go from one collet to the other are engaged while pressing them into the space between the collets, thus increasing the contact arc between the said strands and the rotating sleeve on the empty collet, and effecting progressive breaking of the filaments making up the strands as the strands are subjected to the drawing action of the empty collet, and the linear drive speed of the strands is reduced on the full collet.

The engagement of the strand between the two collets is maintained until the strand is again taken up by the empty collet and until the complete breaking of the portions of the strands held between the collets is accomplished.

The strand is then wound and distributed along the surface of the rotating empty collet.

In the above description, it should be understood that the strands may or may not be regrouped, as the principle of the invention is applicable in either case.

The present invention also has as an object devices for putting the process into operation in accordance with the invention. In accordance with the invention, these devices include:

- a means for forcing the strands between the two collets until the transfer occurs;
- a means for bringing the strand forcing means into action at the time the collets exchange position.

BRIEF DESCRIPTION OF THE DRAWINGS

Other characteristics, objectives and advantages of the present invention will appear more precisely in the course of the following description and with reference to the appended drawings in which:

FIGS. 1A, 1B, and 1C schematically illustrate the different steps of the process of the invention;

DETAILED DESCRIPTION

Figure 2:
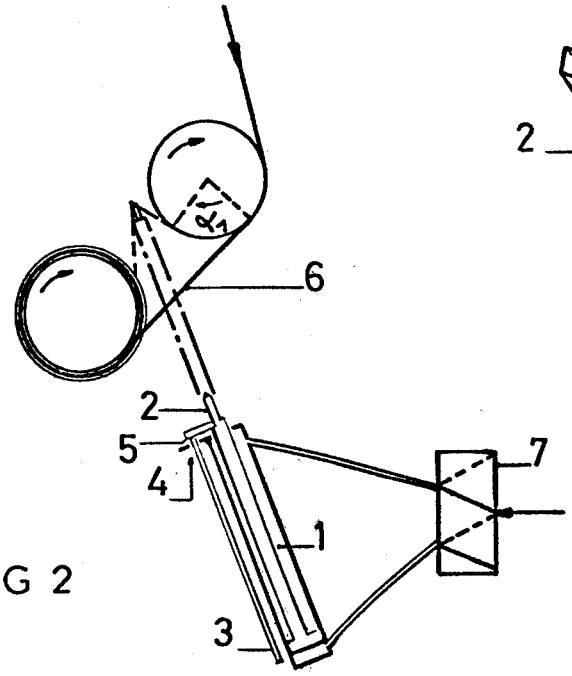
FIG. 2 shows a side view of a first device for putting the process into operation in accordance with the invention.

Turning now to detailed description of the drawings, FIG. 1A shows the beginning of the process of transfer of a strand.

In accordance with conventional technique, collet B1 slows up progressively in the course of winding at a rate which maintains the linear speed of the strand constant during the entire winding period. Thus, at the moment of exchange of the collets, its angular speed W1 is less than the angular speed W2 of the empty collet B2.

The empty collet B2 turning at its maximum speed, has just arrived in the winding position by the pivoting of turret B3, when the full collet B1, still in rotation, but diminished in speed and continuing the attenuation of strand F according to the path indicated by the dots, has arrived at a retracted or rest position.

As soon as the collets are in this new position, a force is exercised which displaces (as designated by the arrow) the portion of strand F held between the collets, so that its path then follows the angled line BAC. The contact arc of strand F on collet B2, which at first was equal to $\alpha 0$, increases by a value of $\alpha 1$.

On a strand of sufficiently low count, as is shown schematically in FIG. 1B, due to the difference between the speed of strand F and the peripheral speed of the empty collet B2 (whether in using only the difference between angular speeds W2 and W1, or in still slowing down collet B1), and also because of the significant increase of the contact arc between the said strand and collet B2, this action results instantaneously in the drawing of strand F by adhesion onto the empty collet. The quantity of strand attenuated by collet B2 becomes greater than the quantity of strand wound by collet B1. This is illustrated by the displacement of point B to $B^1$ which occurs at the beginning of the process, and the slight loosening of the strand which results from this.

Arc $BB^1$ increases rapidly and this portion of strand is wedged as strand F, makes the first complete winding, at the point shown as $B^{11}$ in FIG. 1C.

The tension in portions AC and $AB^{11}$ results in breakage of the strand at point A. The winding of the strand then continues onto collet B2.

For a higher count strand, this transfer action cannot be effected for the reasons presented above. It can only be accomplished if accompanied by the breaking by abrasion at point A of a certain number of filaments making up the strand, which filaments, at least on strands with little or no twist, which is the case here, remain stuck at B2 and are definitively drawn by the transfer action. The traction force exerted by B1 lessens while that exerted by B2 increases proportionately as the filaments break, which favors the attenuation of the partially broken strand by collet B2.

The resumption of winding of strand F by collet B2 is achieved by the breaking of the strand by abrasion which is produced at point A. The winding of the strand can thus proceed onto collet B2.

In accordance with the invention, the process can be put into operation by devices like those described below by way of example.

Figure 2A:
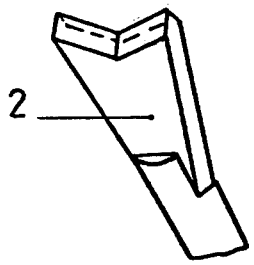
FIG. 2A is a detailed partial view of this device.

The device shown in FIGS. 2 and 2A is adaptable to all present winding turrets, whether they wind a single strand and eject the strand at the end of the sleeve, or whether they wind one or more strands and eject the strands together on the end of the collet. FIG. 2 does not include a showing of the ejection device of the strand or strands, which will be described below. The transfer device includes essentially a jack 1 whose shaft is equipped at the end with a finger 2 having a V-shaped end face whose edges are slightly tapered, with an exterior parallel guide shaft 3 which passes into a hole or eye 4; very rigidly fixed by brace 5 at the end of the shaft of the jack. The guide shaft 3 serves to maintain the orientation of the finger 2 during the operation by preventing rotation of the jack shaft.

Jack 1 can be fastened to the ground or to the frame of the winder itself by any suitable means. It is positioned so that finger 2 moves in a vertical plane which intersects the stretched strand which has been guided to a transfer position by an ejector of the type described below, before the rotation of turret B3.

The shaft of the jack can occupy two positions. In the first or "rest position" the shaft has been retracted and its end is outside the field (the path of movement) of the collets. The turret can thus turn without again meeting finger 2. In the second or "work position" the shaft has been extended and its end is engaged between the two collets.

The orientation of the jack shaft is such that in its movement, finger 2 meets stretched strand 6 between the two collets and draws it in a vertical plane so slowly that it is not severed.

Within installation constraints and available space, it is preferred that the largest possible stroke of the jack be chosen in order to obtain the widest winding arc possible. For the same reason, the jack should be oriented to cause the shaft to pass as close as possible to the empty collet when that collet has moved to the work position, because it is on that collet that an increase in the initial winding arc $\alpha 0$ is sought.

The control method for the jack can be, for example, hydraulic or pneumatic.

Control of the operation can be brought about by an automatically controlled distributor valve 7, as soon as the indexing of the turret is effected; a control signal from the control box of the turret at the end of rotation controls valve 7.

Figure 3:
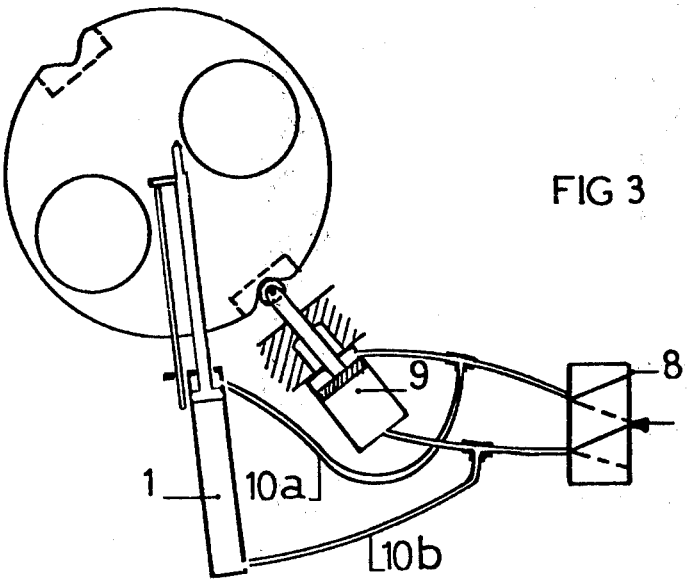
FIG. 3 is a schematic representation of an alternative control system for the apparatus illustrated in FIG. 2.

But as FIG. 3 shows, control of the operation of the jack can be very advantageously brought about at the same time at the location of the turret locking mechanism by distributor 8, which controls the locking jack 9 of turret B3; in this case, jacks 1 and 9 are connected to distributor valve 8 in parallel position. The shaft still remains in the work position during the entire winding operation.

If the jack is fixed to the ground, the two conduits 10*a* and 10*b* which join the jack to the distributor are equipped with two quick connect joining devices in order to be able eventually to remove the winder.

These control methods can be used with any of the following devices and thus will not be taken up again in the description of their functioning.

Figure 4:
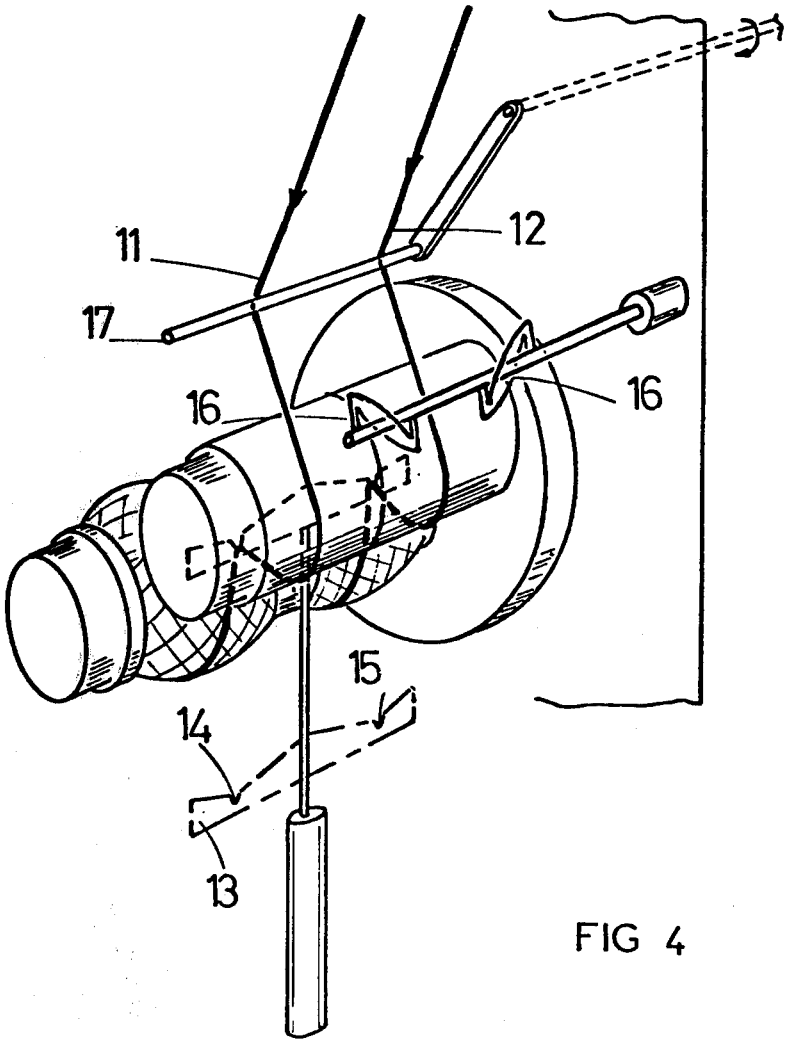
FIG. 4 is a perspective view of a variation of the device shown in FIG. 2.

The device shown in FIG. 4, similar to the preceding, can be adapted to a turret winder simultaneously winding two strands which for transfer are simply removed from the distribution device.

The finger 2 described above is simply replaced by a bar or plate 13, which has two notches 14 and 15, which move in a plane parallel to the rotational axis of the collets. The positioning of jack 1 is such that, during the displacement of plate 13, the two notches 14 and 15 remain in the two vertical planes perpendicular to the axis of the collet; they pass through the middle of the packages, and strands 11 and 12 are situated in them naturally after having been removed from the field of action of the traverse guide 16 by displacement of a cylindrical bar 17 parallel to the axis of rotation of the collets, with a view to their transfer.

In a variation not illustrated, applicable to a winder for winding two strands at the same time which are ejected on the end of their respective sleeves for transfer, the 2 notches 14 and 15 remain, in the course of the displacement of plate 13, in two vertical planes near the end of the sleeves into which strands 11 and 12 have been led for transfer before the rotation of turret B3, by an ejector of known type, like that described in U.S. Pat. No. 3,109,602.

Figure 5:
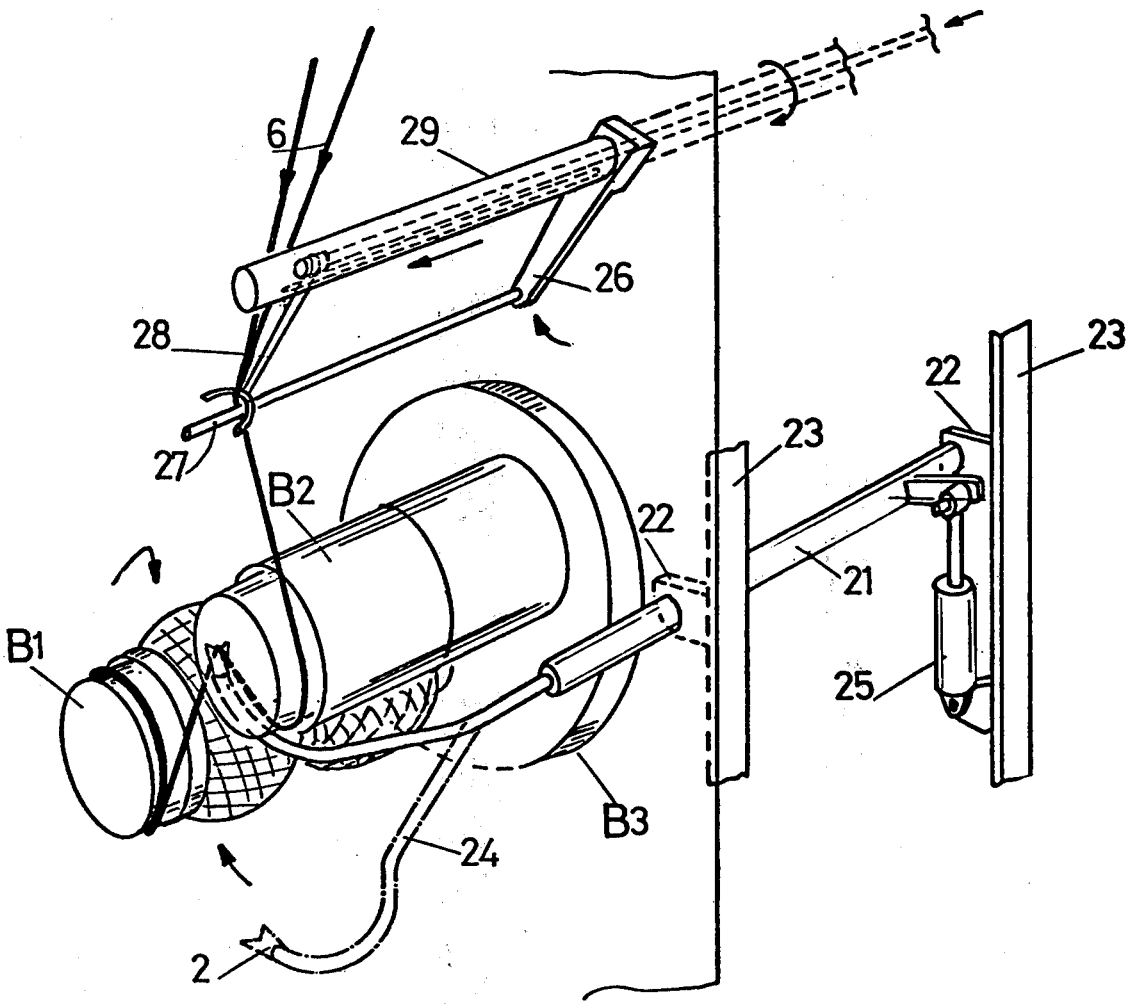
FIG. 5 is a perspective view of another embodiment formed in accordance with the invention.

Another device shown in FIG. 5, is intended for a turret winder onto which the strands are removed together for transfer on the end of the spindle. This device is fastened to the frame of the winder. It is comprised of a horizontal shaft 21 pivotally mounted in bearings 22 fastened to the frame 23 of the winder. This shaft extends parallel to the collets and bears a curved lever 24 at the end of which finger 2 is fastened.

The form and the length of the curved lever 24 are both determined in such a way that the lever does not meet the collets in its movement, so that the winding arc obtained is as wide as possible and so that finger 2 can move in the plane containing the fiber stretched between the two collets in the course of the transfer operation, and can carry this fiber along in its movement.

The assemblage comprising shaft 21, lever 24, and finger 2 can occupy two positions:

"rest" position: lever 24 is retracted and finger 2 is outside the field of the collets; and;

"work" position: the lever is lifted and the finger is engaged between the collets.

Preferably these two positions are obtained by pivoting shaft 21 by the action of jack 25, although other means for pivoting the arm 24 can be used without departing from the scope of the invention.

In FIG. 5, the device for strand distribution has been omitted for reasons of clarity. At the moment of transfer, the strand is disengaged by an ejector. This ejector is made of an arm 36 which carries a rod 27 whose rotation removes the strand from the distribution device. The ejector also carries an ejector fork 28 which slides on support 29, and which leads the strand to the end of the shaft, opposite the spindle end, in the plane of finger 2. An ejector of this type is described in more detail in French Pat. No. 2,291,138.

In the case of the transfer of strands directly on the edge or in the center of the sleeves, finger 2 is replaced with plate or bar 13 as is described above. As for the device shown in FIG. 4, lever 24 is positioned in such a way that notches 14 and 15 are displaced in the vertical planes into which strands 11 and 12 have been led for transfer, whether after a simple removal of the strand from the field of action of the distribution devices 16, or after ejection from the cake.

In order to form large packages of strand, such as cylindrical bobbins, it is necessary to withdraw progressively the mechanism for distribution of the strand in proportion to the enlargement of the package.

Figure 6:
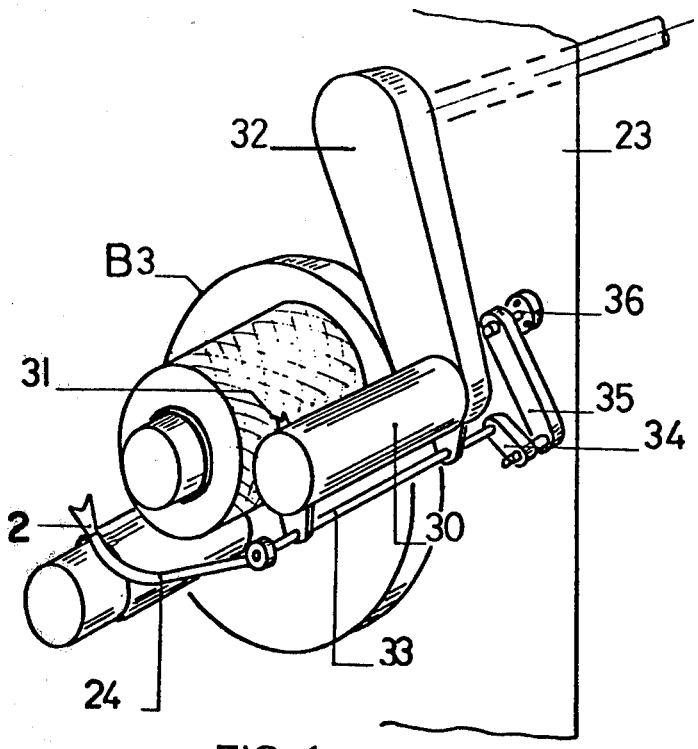
FIG. 6 depicts a variation of the embodiment of FIG. 5.

Another form of the invention adapted for use where the distribution mechanism is continuously withdrawn, is shown in FIG. 6.

Since the distribution mechanism 30 with its strand guide 31 is supported by an oscillating arm 32, it is thus possible to use the movement of this arm to control lever 24.

The preferred method of effecting this comprises a horizontal shaft 33 fastened onto the body of the distribution mechanism 30, parallel to the collet.

The shaft bears curved lever 24 and finger 2, described above, at one of its ends.

The other end of shaft 33 bears a crank handle 34, fastened at a predetermined angle.

Finally, crank handle 34, is jointed at one of its ends with a link 35 whose other end turns around a fixed pivot 36, joined to the frame 23 of the winder.

The relative position of the different axes of rotation of this assemblage as well as the lengths of the crank handle 34 and the link 35 are chosen so as to permit the rapid engagement of lever 24 between the two collets when the oscillating arm support of the distribution device finishes its approach to the collet.

Inversely, when the oscillating arm support starts its withdrawal movement (in order to withdraw the distribution mechanism, to permit either the winding of strand or the pivoting of the turret), lever 24 is very quickly disengaged from between the two collets, and occupies a position near the bottom of the turret.

In accordance with the devices described above, the contact arc of the strand with empty collet B2 is on the average of the order of 130°. The devices permit the transfer either of fine strands (counts less than or equal to 160 tex), whatever their qualities of sliding on a smooth support may be, or of coarse strands (counts between 160 and 1200 tex), which are less slippery on a smooth support.

In order to assure the transfer of very coarse strands (counts more than 1200 tex), it becomes necessary to obtain a contact arc greater than 180°. This can be obtained by the following device which permits the attainment of a contact arc of about 270°.

As shown in FIGS. 7A through 7D, the strand confining element 41 is either a small bar 41*a* with an edge in the form of a single V, 42*a*, or an elongated bar, 41*b*, (FIG. 7C) whose edge is made up of two V's, 42*b*, depending upon whether the transfer is to be brought about on the end of the collet or directly on the sleeves.

Bar 41*a* or 41*b* is fastened to the end of a cylindrical shaft so that it is positioned parallel to the axis of rotation of the spindles.

The method and apparatus described below can be used with any kind of winding turret without modification of the latter, the mechanism being fastened to the ground or to a fixed frame.

The following description applies for both types of confining elements 41.

Confining element 41 is mounted at the end of crank 43. A free moving roller 44 is concentrically mounted with respect to it. The exterior diameter of the roller is several millimeters (about 10 in the illustrative embodiment) greater than the width of the confining element.

Roller 44 will roll on the exterior surface of the end of the spindle while maintaining the confining element at a short distance from the spindle, parallel to its axis. This operation will be explained below.

Figure 7E:
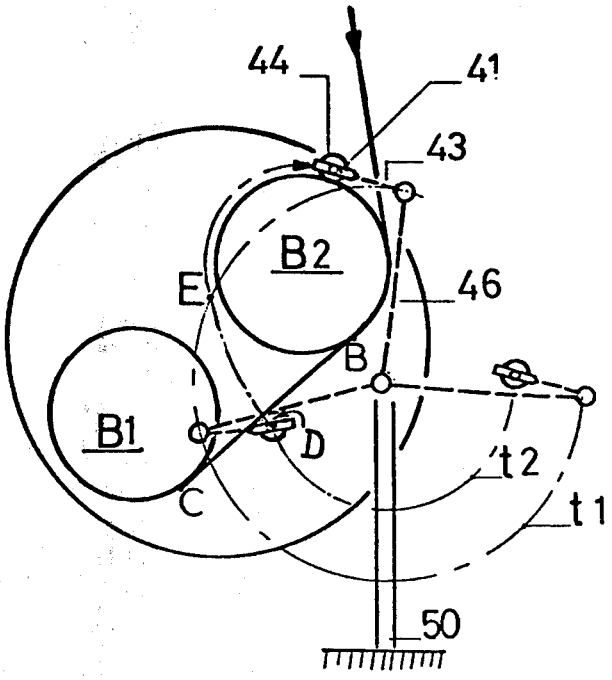
FIG. 7E is a schematic view, in elevation, which depicts schematically the displacement of parts of the embodiments of the invention illustrated in FIGS. 7A–7D.
Figure 7A:
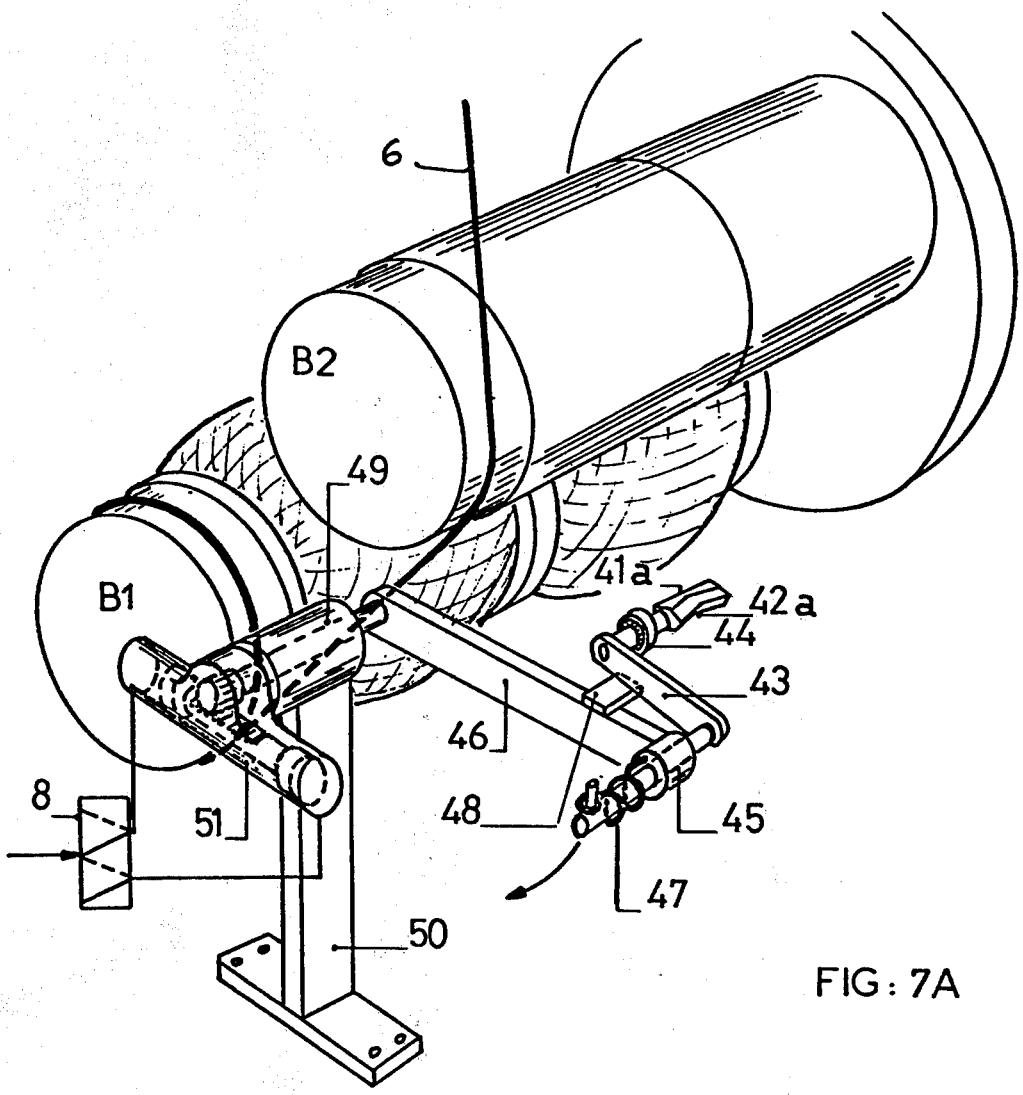
FIG. 7A is a perspective view of a third device formed in accordance with the invention.
Figure 7B:
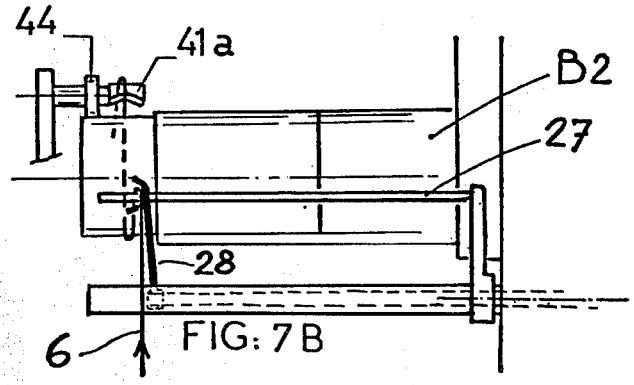
FIG. 7B is a partial schematic view of the device shown in FIG. 7A.
Figure 7C:
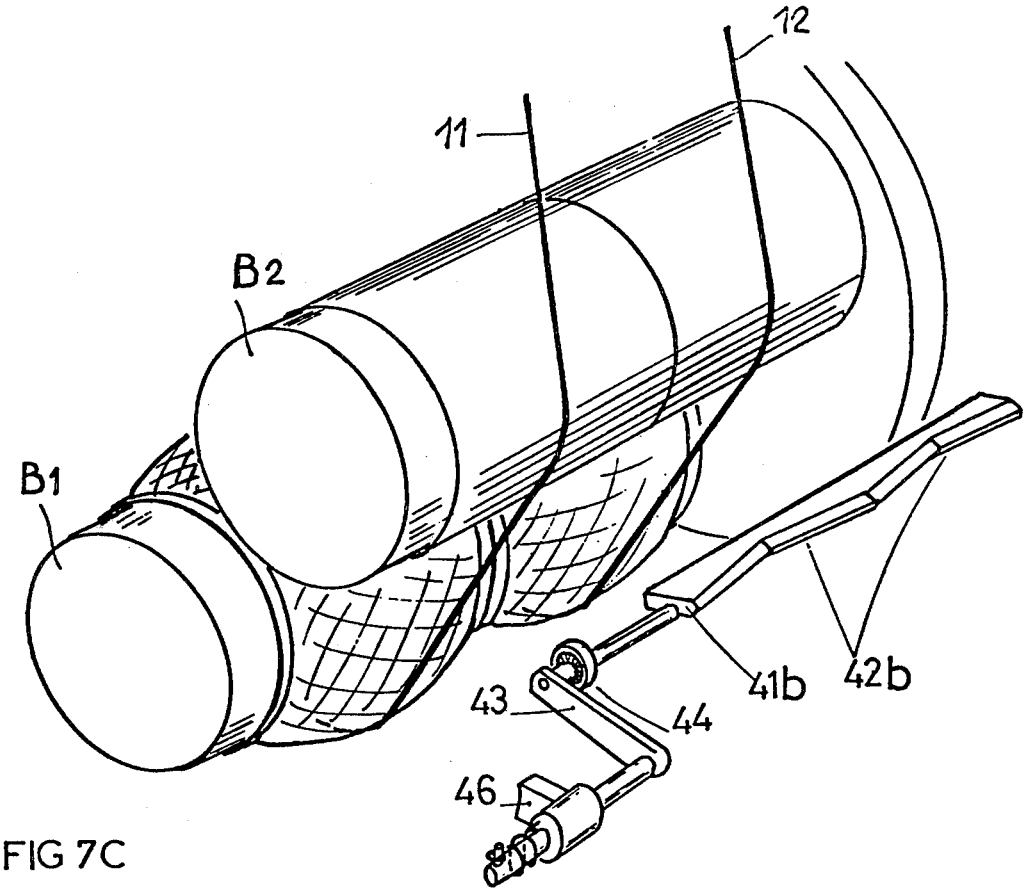
FIGS. 7C and 7D are views of a variation of the device depicted in FIGS. 7A and 7B.
Figure 7D:
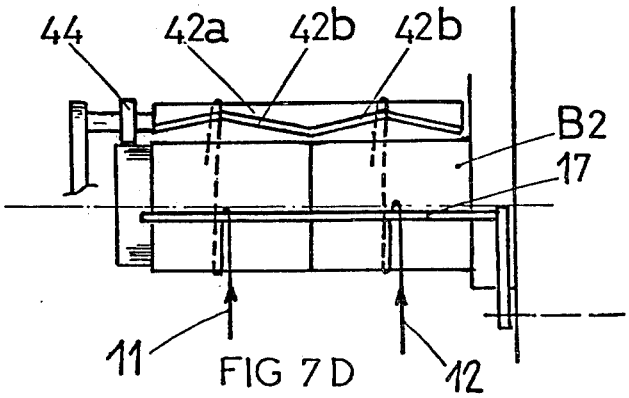

Bearing 45, which holds crank 43, is fastened at the end of rod 46; but, in the rest position, the crank is maintained parallel to the rod and is urged back against it by the effect of a torsion spring 47 which exercises its force in a counter-clockwise direction as viewed in FIG. 7A; the crank thus rests on catch 48.

Rod 46 is journalled in a bearing 49 which is fixed to support 50. Its movement is given by a rotary jack 51 controlled by distributor 8.

As shown with reference to FIGS. 7A and 7E, the rotation angle of jack 51 and the position of support 50, and similarly the length of rod 46 and crank 43, are determined and combined so that the system can occupy the two following extreme positions;

Rest position: rod 46 is horizontal to the eye and to the right of support 50 as viewed in FIG. 7E, in such a way as to hold the confining element 41 outside the field of the collets during a rotation of the torret. The space between collet B1 or B2 and confining element 41 is in addition sufficiently open to permit the passage of a silver and to permit the semiautomatic restarting operations, such as described in French Pat. No. 2,291,138. Finally, the height of support 50 is such that it leaves free access to the collet so that manual restarting can be done there easily.

work position: rod 46 is vertical to the eye, above support 50, the position to which it has been led by a clockwise rotation.

Crank 43 is removed from rod 46 by the contact of roller 44 with the collet.

FIG. 7E shows the trajectory t2 of the axis of the "roller 44—confining device 41" assemblage during the rotation movement of rod 46 following arc t1: at first path t2 is circular, concentric to arc t1 until the confining mechanism 41 meets strand BC stretched between the two spindles. From this moment on, crank 43, which was bent back against rod 46 by the effect of the torsion spring 47, is urged toward the rear by the action of strand BC on the confining mechanism. From point D on, the trajectory is no longer geometrically identifiable (it depends on the tension of strand BC); this is true until point E, which is the point at which roller 44 comes into contact with the spindle and when path t2 again becomes circular, this time concentric to the collet. The strand has been in contact with the confining mechanism since the latter arrived at point D in its trajectory, and it begins to cause the rotation of the bar or confining element in such a way that the edge 42 of the confining element progressively comes to attack and to fray the strand; this continues until the confining mechanism arrives at the end of its run, since the strand is sufficiently weakened to be caught by collet B2, which makes the break.

As in the preceding cases, the devices are positioned in such a way that the orifices of the V-shaped elements 41*a* or 41*b* are displaced in planes perpendicular to the axes of the collets, into which the strands have been led for transfer.

The functioning of the apparatus described above and the sequence of the operations are as follows:

1. When the winding of a cake or bobbin is completed on collet B1, collet B2 is put into rotation at its normal speed, and at the same time the strand leaves the field of action of the strand distribution device, either by the pivoting of a bar 17 (FIG. 4 or 7D) or by an ejection device of the sort currently known and used in fiberglass manufacture, like the assemblage 26 to 29 described above and illustrated in FIG. 5.

2. The inversion of the two collets is brought about by the pivoting of turret B3, an operation whose steps are:

a. unlocking the confining lever and putting it into the rest position, if the action of the lever is brought about by distributor 8 or by the removal or distribution mechanism 30 (FIG. 6).

b. pivoting of the turret c. locking the confining lever and putting it into work position, if the control of the lever is brought about by the same distributor 8 or by the return of distribution mechanism 30.

3. Collet B1 is slowed down.

4. The empty collet in the work position takes up the strand.

5. At the end of its forced displacement, the strand, weakened by the abrasion of the finger, breaks and undergoes the transfer onto the empty collet.

6. Bar 17 or ejector 26 to 29 is put into "retracted" position, which causes the strand to be led into the field of action of the distribution device and causes the new cake to be started.

According to the detailed description of the transfer process in accordance with the invention, several important advantages over earlier techniques are discovered. These advantages are the following:

a. the transfer of the strand can be brought about on any surface, whether it be smooth, like the surface of the collet or of plastic sleeves, or more irregular, like that of the cardboard sleeves currently used.
b. within the range of presently known strand, the transfer process can be assured whatever the count of the said strand may be.
c. strand transfer can likewise be effected independently of the position of the said strand as related to the winding.
d. strand transfer does not require precise control for braking the full bobbin or cake in the course of transfer.

Other advantages result from the detailed description of the different methods for carrying out the invention:

a. these devices can be fixed to winding turrets without necessitating particular modification to the latter.
b. they can be adapted to all types of turret winders which have two or more collets.

What is claimed is:

1. Apparatus for the attenuation and winding of glass strand or like materials, said apparatus comprising an indexable turret having plural cylindrical winding collets mounted for rotation at spaced apart locations thereon, drive means for rotation of said collets and for indexing of said turret to a position in which an empty collet is shifted to a winding station in which strand is wound on its surface and an adjacent collet on which strand has been wound is shifted to a transfer station, said drive means maintaining the collets at each of said stations in rotation and a shiftable strand engaging control device moveable from a retracted position clear of the collets upon indexing movement of the turret to an operative position when a rotating empty collet is at the winding station, said strand engaging control device having an end portion configured to abrade and to press the strand between the full and empty collets when in said operative position to bring the strand into contact with a substantial portion of the circumference of said empty collet, the arc of contact being sufficient to effect adherence of the strand to the empty collet and to effect breakage of the strand between the full and empty collet by abrasion on the end portion of the control device as winding is commenced on the empty collet and continues on the full collet.

2. Apparatus according to claim 1 wherein said collet drive means comprises means for driving said full collet at lower angular speed than the empty collet as said control device is moved to operative position.

3. Apparatus according to claims 1 or 2 wherein said control device comprises a rectilinear displacement shaft, a strand engaging finger on the end of said shaft, means mounting said shaft for movement in a vertical plane, from a retracted position in which the finger is out of the path of movement of said collets to an operative position between said collets in which the finger engages and draws said strand into arcuate contact with the surface of the empty collet.

4. Apparatus according to claim 3 wherein the finger maintains the angle of arcuate contact of the strand on the empty collet at between 90° and 180°.

5. Apparatus according to claims 1 or 2 wherein said shiftable control device comprises an arm having a strand engaging finger at one end, the shaft portion adjacent the finger having a curved configuration, pivotal mounting means for said shaft for moving said finger from a retracted position remote from the collets to an operative position between the collets with the finger in contact with the strand, the curvature of the arm describing an arc which is concentric with respect to the circumference of the collet in the winding position when the finger is in the operative position.

6. Apparatus according to claim 3 wherein said strand engaging finger comprises a bar extending axially of the collets, said bar having a pair of strand engaging indentations spaced lengthwise thereof for drawing a pair of strands into contact with the empty collet.

7. Apparatus according to claim 5 wherein said strand engaging finger comprises a bar extending axially of the collets, said bar having a pair of strand engaging indentations spaced lengthwise thereof for drawing a pair of strands into contact with the empty collet.

8. Apparatus according to claim 1 wherein said shiftable strand engaging control device comprises a first lever, pivotal mounting means including a pivotal connection on one end of said first lever, a spacing device mounted on the other end thereof for contact with the periphery of a collet at the winding station, a strand engaging finger mounted on said lever adjacent said spacing device, said finger being positioned in a plane in which the strand is located when an empty collet is moved to the winding station, said lever pivotal mounting means being operative to effect movement of said lever from a retracted position clear of said collets to a first operative position in which the finger intercepts the strand at a position between said collets, to a second operative position in which the spacing device contacts the surface of the collet at the winding station with the strand being drawn around the said surface, said finger being mounted in relation to the spacing device so that the spacing device at all times maintains the finger out of contact with the collet at the winding station, the direction of motion of the finger by said pivotal mounting means being the same as the direction of rotational movement of the collet at the winding station.

9. Apparatus according to claim 8 wherein said pivotal mounting means comprises a resilient device, effective upon engagement of said finger with the strand, for yieldingly urging said finger against said strand and said spacing device against the surface of the collet at the transfer station.

10. Apparatus according to claim 8 or 9 wherein the angle of arcuate contact of the strand with the collet at the winding station when the finger is in the last-named position is between about 180° and 270°.

11. Apparatus according to claim 9 wherein said spacing device is a roller.

12. Apparatus according to claim 9 wherein said pivotal mounting means comprises a second lever adjacent the winding station, said resilient device comprises a spring interconnecting said two levers, with the first urged by said spring on said pivotal connection to a retracted position wherein said levers are acutely angled with respect to one another, a pivotal mounting for the second lever, means for moving said levers as a unit about said last named pivotal mounting until said finger contacts said strand, said spring permitting relative movement of said levers about said first named pivotal connection as said finger draws said strand during movement from said first to said second operative position.

13. Apparatus according to claim 12 wherein said pivotal mounting means further comprises means for moving said finger to a third operative position angularly spaced on said collet from the second arcuate position in the direction of movement of the collet, at the winding station, said third arcuate position being offset from the second in the direction of movement of the collet at the winding station.

14. Apparatus according to claim 13 wherein said finger comprises a bar extending axially of the collets, said bar having a pair of strand engaging indentations spaced lengthwise thereof for drawing a pair of strands into contact with the empty collet at locations spaced lengthwise of the collet.

* * * * *

UNITED STATES PATENT AND TRADEMARK OFFICE

CERTIFICATE OF CORRECTION

PATENT NO. : 4,210,293

DATED : July 1, 1980

INVENTOR(S) : Georges Fromaget

It is certified that error appears in the above—identified patent and that said Letters Patent is hereby corrected as shown below:

Col. 6, line 24 "arm 36" should be --arm 26--.

Col. 7, line 61 "torret" should be --turret--.

Col. 7, line 63 "silver" should be --sliver--.

Signed and Sealed this

Tenth Day of March 1981

[SEAL]

*Attest:*

RENE D. TEGTMEYER

*Attesting Officer* *Acting Commissioner of Patents and Trademark*